United States Patent [19]

Meyer et al.

[11] 4,044,505

[45] Aug. 30, 1977

[54] ETCHING DEVICE FOR GLASS OR OTHER ETCHABLE SURFACES

[75] Inventors: Burton C. Meyer, Downers Grove; Ralph J. Kulesza, Chicago, both of Ill.

[73] Assignee: Marvin Glass & Associates, Chicago, Ill.

[21] Appl. No.: 642,153

[22] Filed: Dec. 18, 1975

[51] Int. Cl.[2] ..... B28D 1/22

[52] U.S. Cl. ..... 51/5 R; 51/59 R; 125/6

[58] Field of Search ..... 51/59 R, 59 SS, 109, 51/310, 283, 5 R; 125/40, 6

[56] References Cited

U.S. PATENT DOCUMENTS

| | | | |
|---|---|---|---|
| 1,604,152 | 10/1926 | Drescher | 51/310 |
| 2,504,831 | 4/1950 | Griss | 51/59 SS |
| 2,774,193 | 12/1956 | Thatcher | 51/59 SS |
| 3,210,893 | 10/1965 | Jackson | 51/109 |
| 3,837,121 | 9/1974 | Schirmer | 51/59 SS |

*Primary Examiner*—Harold D. Whitehead
*Attorney, Agent, or Firm*—Mason, Kolehmainen, Rathburn & Wyss

[57] ABSTRACT

A device and method for etching designs on glass or like surfaces by a sand erosion process. The device has a housing with a vibratory motor mounted therein. The motor drives a sharp or tapered carbide engraving blade or tip through a reciprocating axial motion at a high rate of speed. The blade can be used to engrave or chisel outlines or silhouettes of designs on a glass surface. The device is also provided with a sand erosion adaptor which can be removably fixed on the blade providing a more blunt working end. Sand is delivered from a sand supply in the housing through the sand erosion adaptor and onto the glass surface so that the reciprocal motion of the adaptor grinds or pounds sand against the glass surface to produce an etching effect on the surface. Vibration of the motor means helps the delivery of sand through the head by agitating the sand for freer gravity flow.

For work on small manipulatable items such as water glasses or the like, the device is provided with a base support having a recessed receptacle for containing spent sand dropping from the work piece. The housing is detachable from the base and can alternatively be mounted on a rocker base so that the housing can be rocked toward and away from a work piece. This facilitates work on larger pieces such as plate glass which cannot be easily handled or held against the work head. Provision is made for adjusting the stroke of the blade and erosion adapter, whether it be during an engraving operation or an etching operation.

9 Claims, 8 Drawing Figures

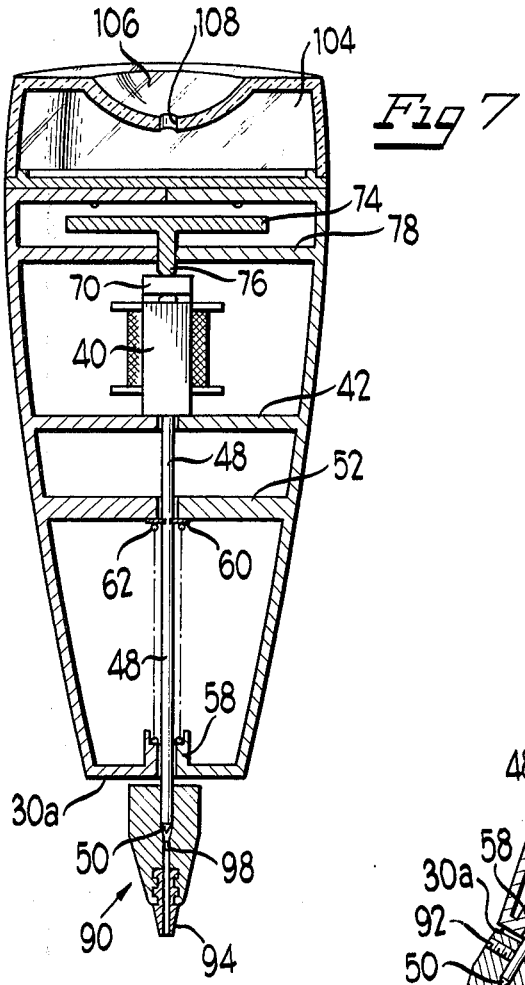
Fig 7
Fig 6
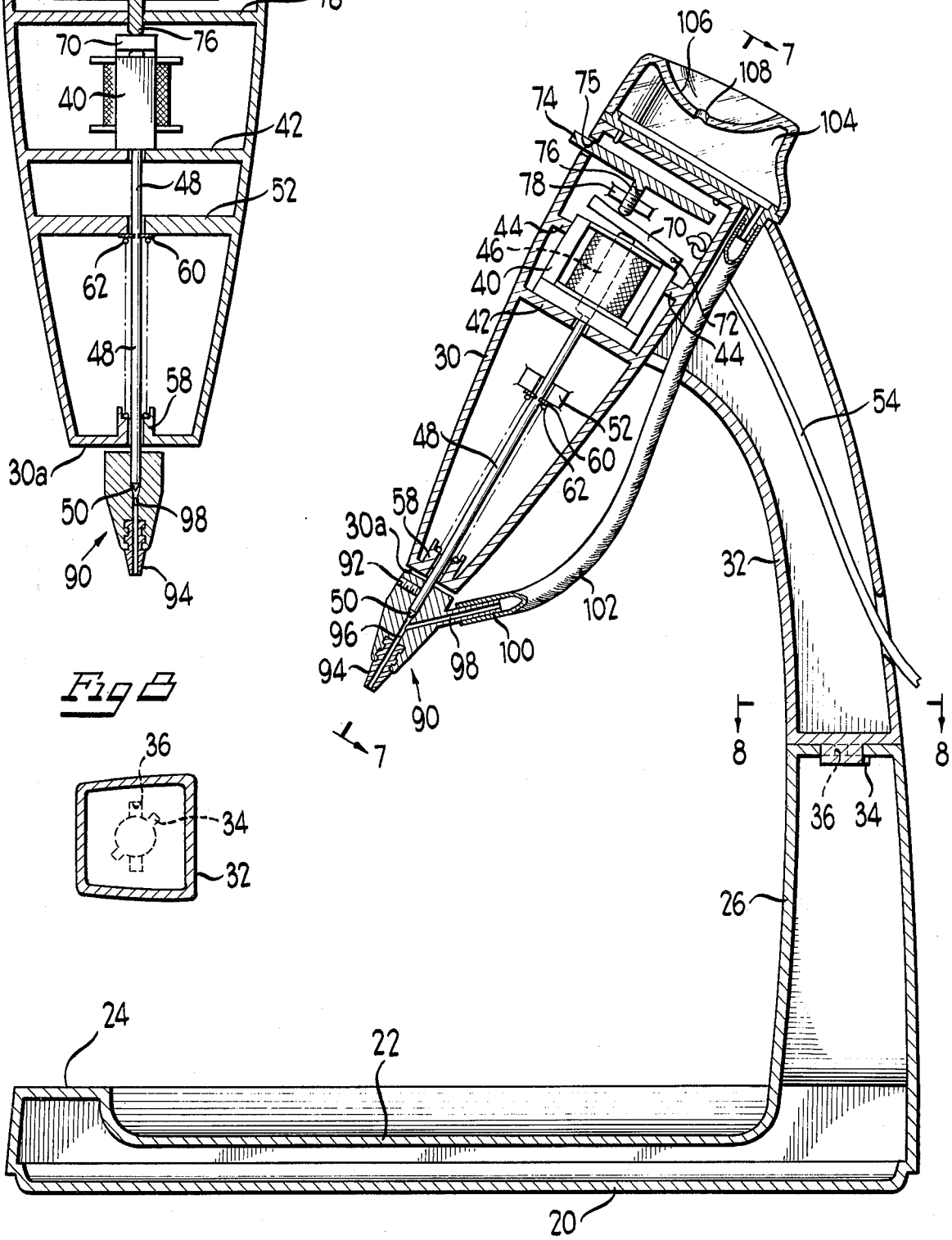
Fig 8

ETCHING DEVICE FOR GLASS OR OTHER ETCHABLE SURFACES

BACKGROUND OF THE INVENTION

1. Field of the Invention

This invention relates to an apparatus for producing etched designs on glass or like surfaces. More particularly, the invention relates to such a device and a method employing sand erosion for production of etched designs.

2. Brief Description of the Prior Art

The etching of designs on glass or the like is normally carried out by chemical processes involving the use of strong acids to eat away or erode the surface glass material in the desired design. Such methods are very effective but they involve the use of corrosive acids and other materials which are difficult to handle safely.

SUMMARY OF THE INVENTION

The present invention provides a new and useful method and apparatus for etching designs on glass or like surfaces. The apparatus includes a housing with an operative vibratory motor means mounted in the housing. The motor drives a working head through reciprocating vibratory strokes. The working head receives sand from a supply in the housing and the sand is deposited on the glass or other work surface and ground or pounded against the surface by the working head.

The working head is removably mounted on a glass engraving blade or tip so that when it is desired to engrave a portion of the glass, e.g., as a silhouette or outline on the glass to be etched, the working head can be removed exposing the engraving blade which operates through the same vibratory motion. A control is provided to adjust the length of the vibratory stroke.

The method of the invention involves the application of the etching working head to the glass surface while vibrating the working head and delivering sand between the working head and the glass surface.

While this invention is susceptible of embodiment in many different forms, there is shown in the drawings and will herein be described in detail a specific embodiment and modification thereof, with the understanding that the present disclosure is to be considered as an exemplification of the principles of the invention and is not intended to limit the invention to the embodiment illustrated.

BRIEF DESCRIPTION OF THE DRAWINGS

FIG. 6 is an enlarged vertical sectional view through the device shown in FIGS. 1 and 2;

FIG. 7 is a sectional view along line 7—7 of FIG. 6; and

FIG. 8 is a sectional view along line 8—8 of FIG. 6.

DESCRIPTION OF THE PREFERRED EMBODIMENT

Figure 1:
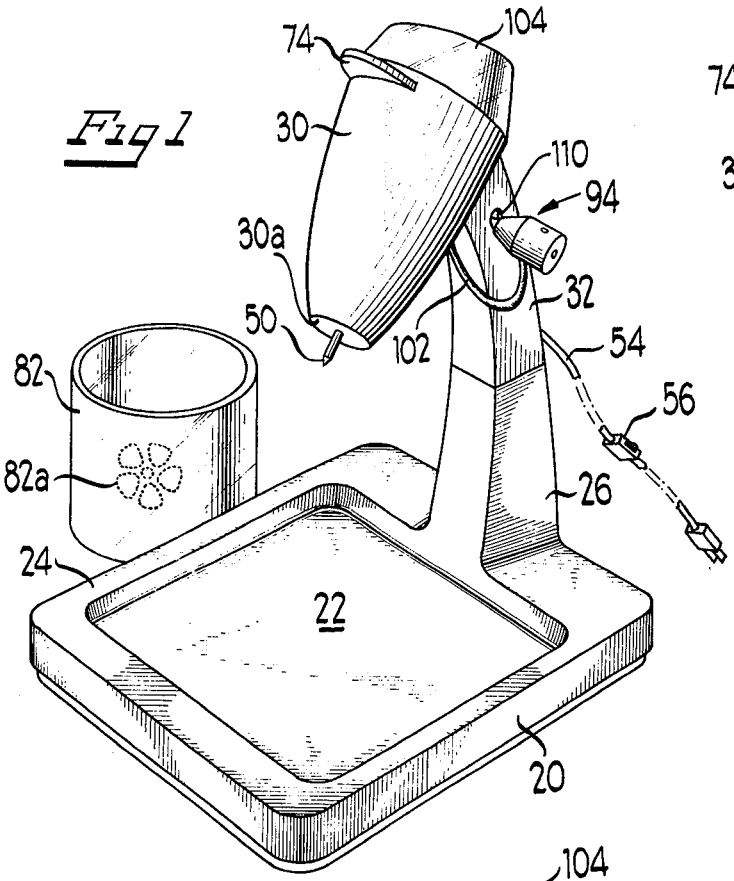
FIG. 1 is a perspective view of the apparatus of the present invention mounted on a stationary stand, with the etching head or erosion adapter removed from the engraving blade and in storage position.
Figure 2:
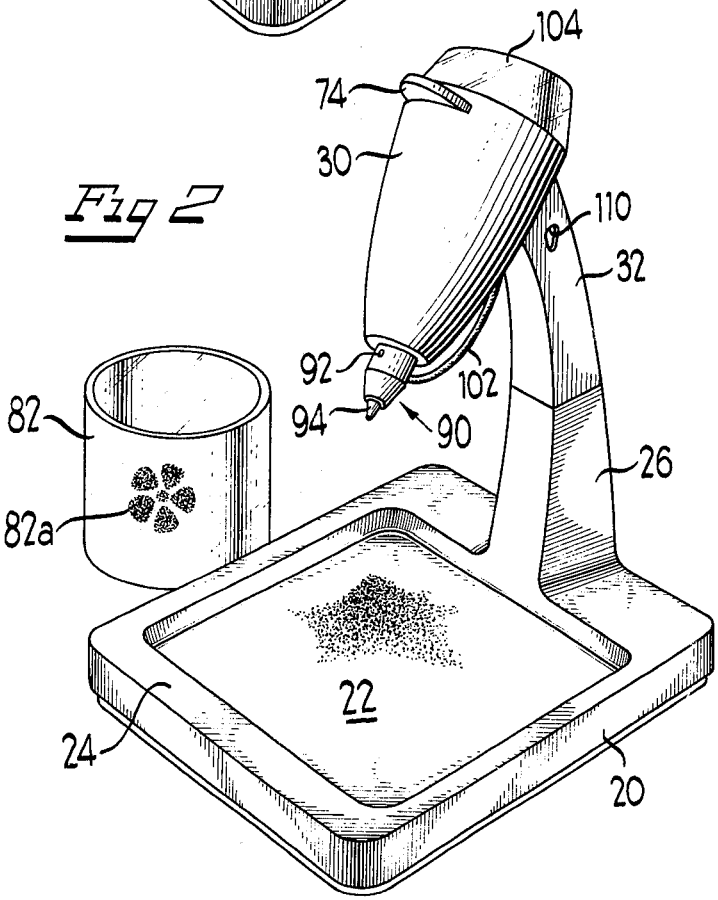
FIG. 2 is another perspective view of the device of FIG. 1 showing the etching head in working position.

Turning first to FIGS. 1 and 2, the illustrated embodiment includes a base 20 having a recessed receiver 22 defined by a peripheral flange or rim 24 and having a post 26 upstanding from base 20. A housing 30 has a depending leg 32 which is releasably attached to the top of post 26 by a turn key 34 (FIG. 8) on the bottom of leg 32 received and turned within a key way 36 so that housing 30 is rigidly supported through leg 32 and post 26 from base 20.

In housing 30 a motor in the form of an alternating current solenoid 40 (FIGS. 6 and 7) is securely mounted across a frame member 42 and by cross frame stubs 44. A reciprocating armature 46 forms the drive portion of solenoid 40. An elongated rod or blade 48 terminating in a tapered or chiseled tip 50, composed of an ultra hard material such as carbide steel or the like, is mounted through bores in the frame members 42 and 52 and the lower end of **30*a* of housing 30 for sliding axial reciprocal movement. The solenoid 40 is supplied with appropriate power, e.g., 110 volts, through a power cord 54 and is controlled by an on-off switch 56 (FIGS. 1 and 6**).

Rod 48, in the rest position as shown (FIG. 6), projects through and beyond the cross frame member 42 for engagement with the end of the armature 46 on the downward stroke of the armature. At the lower end of the housing, at 30a, a bushing or collar 58 is secured within the housing, and rod 48 is axially slideable therethrough. A clamp ring 60 is secured to the rod 48 and a compression spring 62 is biased between the collar 58 and the clamp ring 60 to retain the upper end of rod 48 as seen in FIG. 6 in abutment with armature 46 so that as the armature 46 reciprocates during operation of the solenoid 40, rod 48 is intermittently driven downwardly by armature 46 and returned by spring 62 at a fast reciprocating rate producing a vibratory action of tip 50 and/or working head 90.

Manually operable stroke adjusting means is provided for adjusting the length of reciprocal movement of armature 46 and, therefore, adjusting the overall stroke. Accordingly, a stroke limiting plate 70 is pivotally mounted at 72 to the top of solenoid 40. A thumb wheel 74, partially accessible for manipulation from the exterior casing 30 by partial projection through a slot 75, is provided with a threaded screw portion 76 received in mating threads through a cross frame member 78 with the end of screw portion 76 engaging the top of plate 70. It will be seen that turning of the thumb wheel 74 and 76 in one direction will pivot plate 70 downwardly, depressing and limiting the upward movement of armature 46. Turning thumb wheel 74 in the other direction will permit a longer stroke by armature 46.

Figure 5:
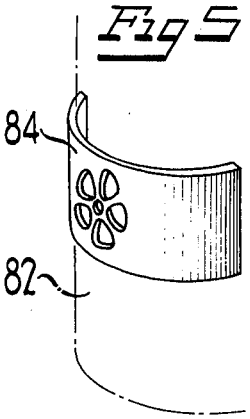
FIG. 5 is a perspective view of a template which can be applied to a curved glass surface to outline a working area thereon.

In operation, the solenoid 40 is energized, rod 48 is driven through a reciprocal axially stroke and when tip 50 is exposed, i.e., with head 90 removed, a glass, such as shown at 82 in FIG. 1, or other glass item can be held against the vibrating tip 50 for engraving a design, outline or silhouette **82*a* on the surface thereof. Useful as guides or outlines for making such designs are pressure sensitive adhesive backed templates, such as is shown at 84 in FIG. 5**.

Figure 3:
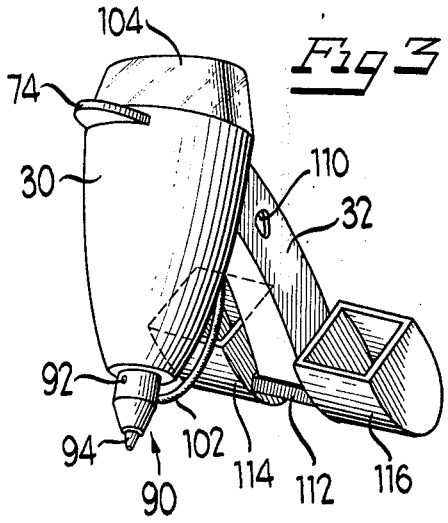
FIG. 3 is a perspective view of the device as shown in FIGS. 1 and 2 but mounted on a rocker stand rather than a stationary stand.
Figure 4:
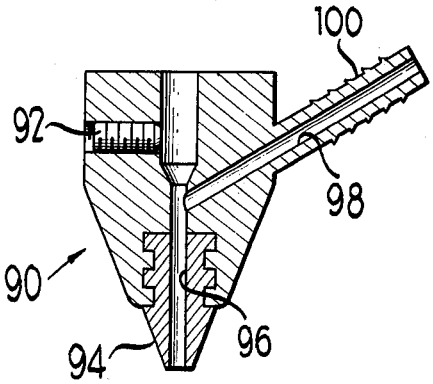
FIG. 4 is an enlarged section through the etching head shown on the device of FIGS. 1 through 3.

The device is provided with a sand erosion or etching head adapter 90 which can be removably secured to rod 48, as by a set screw 92 (FIG. 4). Head 90 has an etching tip 94 of hard material such as carbide steel, a central axial bore 96 and a laterally extending bore 98 which extends through a nipple or connector tube 100. A flexible conduit 102 (FIGS. 1 through 3 and 6) extends from tube 100 to a sand reservoir 104 (FIGS. 6 and 7). Sand reservoir 104 has walls of a transparent material so that the amount of sand in the reservoir 104 can readily be visually determined. The top wall 106 of reservoir 104 is concave providing a funnel-like surface and has a generally centrally located filling port 108 for funneling sand into reservoir 104. The bottom of tip 94 is flat so as to capture sand against a glass surface for abrasion purposes, as the sand emerges from bore 96.

In operation of the device for engraving glass the etching head 90 is removed from end 50 of rod 48 and can readily be stored by suspending the head from a port 110 provided in the side wall of leg 32 as seen in FIG. 1. Once the outline or silhouette of the design has been engraved as shown at 82*a* in FIG. 1, the etching head 90 can be placed on rod end 50 and secured by set screw 92. When motor 40 is energized, the vibratory action will shake the sand in reservoir 104 and enhance its flow through tube 102 thence through bores 98 and 96 for emission from the end of tip 94 onto a glass surface. By holding the glass work piece against the tip 94 the sand will cause a sand etching action with the tip 94 reciprocating along with rod 48. The recessed receiver 22 will catch spent sand as the etching process continues.

In some instances the piece, such as a flat plate of glass, may be too large or bulky to conveniently handle and manually move against the tip 50 or etching head 90. For such pieces, a modification is provided as shown in FIG. 3. In the modification, leg 32 is secured to a base plate 112 which in turn is fastened to a pair of rockers or fulcrums 114 and 116, one on each side of leg 32. In this mode of assembly, the housing 30 may be rocked on rockers 114 and 116 forward until chisel end 50 or head 90 comes to rest on the work piece for the desired operation. The device may be moved about the work piece to complete the desired design.

The device and method of this invention have advantages that will be evident to those skilled in the art of engraving and etching. The device is compact and easily handled and eliminates the need for strong chemical solutions while still providing an excellent etched appearance to a work piece.

We claim:

1. An arts and crafts apparatus for etching designs on glass, plastic, or like etchable surfaces comprising:

a housing;

an operative vibratory motor means mounted on said housing;

an engraving blade driven by said motor means, a working head, including surface means engageable with an etchable surface, driven by said motor means through reciprocating vibratory strokes, said working head being removably mounted on said engraving blade so that with the head removed, the blade can be used for engraving outlines on the glass;

a supply of particulate abrasive material such as sand or the like; and means for flowing and delivering said sand from said supply to said head during vibration thereof to trap the sand between said surface means and the glass piece to etch the glass piece by abrasive action of the sand.

2. The device of claim 1 including means on said housing for storing said working head when not in use.

3. An arts and crafts apparatus for etching designs on glass, plastic or like etchable surfaces comprising:

a housing;

an operative vibratory motor means mounted on said housing;

an engraving instrument operatively associated with and driven by said motor means for reciprocating vibratory motion for contacting and engraving designs on a glass piece;

a removable working head, including surface means engageable with the glass piece, releasably fixable with said engraving instrument to be driven thereby through said motor means for vibratory motion therewith;

a supply or sand or like abrasive material; and means flowing and delivering said sand from said supply thereof to said working head during vibration thereof to trap the sand between said surface means and the glass piece to etch the glass piece in or around said engraved design by abrasive action of the sand.

4. The etching apparatus of claim 3 wherein said working head has conduit means in communication with said supply of sand for delivery of the sand from said supply through the working head to the surface means thereof.

5. The etching apparatus of claim 3 wherein said supply of sand is disposed in a container above said working head and the sand from the supply thereof is delivered to the working head through gravity and vibratory motion of said housing through said conduit means.

6. The etching apparatus of claim 5 wherein said supply of sand is disposed in a container mounted directly on said working head for vibratory motion therewith.

7. The etching apparatus of claim 5 wherein said container comprises a receptacle for the sand and including funnel means for delivering sand into the receptable.

8. The etching apparatus of claim 3 wherein said working head is removably mounted on an upstanding portion of said housing.

9. The etching apparatus of claim 3 wherein said housing has means thereon for storing said working head when removed from said engraving instrument.

* * * * *